US009150348B2

(12) United States Patent
Naber et al.

(10) Patent No.: US 9,150,348 B2
(45) Date of Patent: Oct. 6, 2015

(54) AIR CARGO CONTAINER AND FLEXIBLE DOOR FOR USE IN SUCH A CONTAINER

(71) Applicant: TYPE22 B.V., Delft (NL)

(72) Inventors: Jorick Naber, Haarlem (NL); Leander Henricus Albertus Ross, Delft (NL); Reinout Vander Meûlen, Delft (NL); Bart René Yvonne Houlleberghs, 's-Gravenhage (NL); Roel Reijnen, Rotterdam (NL)

(73) Assignee: TYPE22 B.V., Delft (NL)

( * ) Notice: Subject to any disclaimer, the term of this patent is extended or adjusted under 35 U.S.C. 154(b) by 0 days.

(21) Appl. No.: 14/370,339

(22) PCT Filed: Jan. 2, 2013

(86) PCT No.: PCT/NL2013/050002
§ 371 (c)(1),
(2) Date: Jul. 2, 2014

(87) PCT Pub. No.: WO2013/103300
PCT Pub. Date: Jul. 11, 2013

(65) Prior Publication Data

US 2015/0069050 A1 Mar. 12, 2015

(30) Foreign Application Priority Data

Jan. 2, 2012 (NL) ..... 2008070

(51) Int. Cl.
*B65D 88/14* (2006.01)
*B65D 90/02* (2006.01)
(Continued)

(52) U.S. Cl.
CPC ..... *B65D 88/14* (2013.01); *B65D 90/008* (2013.01); *B65D 90/021* (2013.01); *B65D 90/54* (2013.01)

(58) Field of Classification Search
CPC ..... B65D 88/121; B65D 88/12; B65D 88/10; B65D 88/02; B65D 90/047; B65D 90/046; B65D 90/04; B65D 88/14; B65D 90/008; B65D 90/021; B65D 90/54; F17C 3/025; F17C 3/027; F17C 3/02
USPC ..... 220/560.11, 1.5, 1.6, 9.4
See application file for complete search history.

(56) References Cited

U.S. PATENT DOCUMENTS 3,294,034 A * 12/1966 Bodenheimer et al. ..... 410/1
3,515,303 A * 6/1970 Hannah et al. ..... 220/562
(Continued)

FOREIGN PATENT DOCUMENTS

DE 20214619 U1 11/2002
EP 0127936 A1 12/1984
(Continued)

OTHER PUBLICATIONS

International Search Report and Written Opinion mailed May 2, 2013 (PCT/NL2013/050002); ISA/EP.
(Continued)

*Primary Examiner* — Robert J Hicks
(74) *Attorney, Agent, or Firm* — Banner & Witcoff, Ltd.

(57) ABSTRACT

An air cargo container comprising a skeleton structure of interconnected frame members to which are arranged face panels forming at least one wall between the frame members. At least one of the walls comprises an opening providing access to the interior of the container, whereby the opening covers substantially the complete surface area of said wall between the outermost of the frame members. Parts of the outermost frame members forming the peripheral edge of the opening are provided with a connector for connecting a stiffening member to the peripheral edge, said stiffening member being provided to link said parts under tension.

17 Claims, 4 Drawing Sheets

(51) Int. Cl.
*B65D 90/00* (2006.01)
*B65D 90/54* (2006.01)

(56) References Cited

U.S. PATENT DOCUMENTS

| | | | | |
|---|---|---|---|---|
| 5,109,998 | A | 5/1992 | Bretschneider | |
| 5,360,129 | A * | 11/1994 | Lee | 220/1.5 |
| 5,941,405 | A | 8/1999 | Scales et al. | |
| 6,299,009 | B1 | 10/2001 | Ryziuk et al. | |
| 6,991,124 | B1 * | 1/2006 | Palley et al. | 220/1.5 |

FOREIGN PATENT DOCUMENTS

| | | | |
|---|---|---|---|
| EP | 1061009 | A1 | 12/2000 |
| GB | 1470448 | A | 4/1977 |

OTHER PUBLICATIONS

Second Written Opinion mailed Jan. 31, 2014 (PCT/NL2013/050002); ISA/EP.

IPRP completed on Apr. 1, 2014 (PCT/NL2013/050002); ISA/EP.

* cited by examiner

AIR CARGO CONTAINER AND FLEXIBLE DOOR FOR USE IN SUCH A CONTAINER

The present application is a U.S. National Phase filing of International Application No. PCT/NL2013/050002, filed on Jan. 2, 2013, designating the United States of America and claiming priority to Netherlands Patent Application No. 2008070, filed Jan. 2, 2012. The present application claims priority to and the benefit of all the above-identified applications, and all the above-identified applications are incorporated by reference herein in their entireties.

FIELD OF THE INVENTION

The present invention relates to air cargo containers of the type used for transporting cargo, baggage and mail. The invention in particular relates to an air cargo container comprising a skeleton structure of interconnected frame members to which are arranged face panels forming walls between the frame members, at least one of which walls comprises an opening providing access to the interior of the container. The invention also relates to a flexible door for such an air cargo container.

BACKGROUND OF THE INVENTION

Typically, air cargo containers, often referred to as Unit Load Devices (ULDs) are shaped as boxes which can include appropriately sloped surfaces that conform the air cargo container to the aircraft's fuselage when the air cargo container is placed in the aircraft's cargo compartment. ULDs meant to be loaded into an aircraft's lower deck cargo compartment—lower deck containers—in general are equipped with sloped lower side walls, joining the edge of the base to the vertical upper side walls. Upper deck containers on the other hand have sloped upper side walls and vertically upward extending lower side walls attached to the ULD's base panel.

Essentially, the container is made of several panels which are joined together to form the air cargo container and define an enclosed or partially enclosed volume. Additionally, an air cargo container typically has a door which allows it to be opened for placing e.g. cargo or baggage in the air cargo container or for removing the payload from the air cargo container. Air cargo containers must conform to various national and international standards and specifications. These standards and specifications are set forth in amongst others the National Aerospace Standard (NAS) 3610 and the International Air Transport Association (IATA) ULD Technical Manual. In these documents, the required characteristics of air cargo containers, such as for instance the ability to sustain defined vertical and lateral loads and impacts, shear forces and fire resistance are set out. Likely the most severe load criterion is the downward load case. In case of an upper deck container, the vertical downward load is exerted fully on the base panel of the container. In case of a lower deck container on the other hand, the vertical downward load is partially exerted on the base, and partially on the—sloped—lower side walls. Heavy loading of the sloped lower side walls may result in substantial deformation.

Presently there are roughly two known types of air cargo containers. The first and most common type is equipped with a so-called shear panel that spans over part of the front surface of the air cargo container to obtain the necessary stiffness, and as such forms an integral part of the container's structure. The remaining part of the front surface is used as access opening. To close the opening off when loaded, a flexible fabric door spanning the opening may be used. An air cargo container of this type is disclosed in U.S. Pat. No. 5,109,998 for instance. Another air cargo container having a shear panel is disclosed in U.S. Pat. No. 5,941,405, which shows a collapsible container having a shear panel in the form of an outboard wing or 'pallet extension'. The pallet extension extends outwardly of the container base so that the container assumes a so-called 'LD3' unit load device configuration. As can be seen in FIG. 1 of U.S. Pat. No. 5,941,405, the pallet extension 26 blocks a part of the available maximum opening surface area, which is undesirable. Another example of this type of container is disclosed in DE 20214619U1, see FIG. 1, and in EP0127936 A1, see FIG. 1. EP 1061009A1 discloses a further example of a collapsible container having a shear panel to obtain the necessary rigidity. As is clear from FIG. 1 of EP 1061009A1, the shear panel blocks part of the front opening extending between walls 4, 8, 7 (and 5, 6).

A second type of air cargo container is equipped with a solid door, often constructed from aluminium or an aluminium alloy and comprising a top and bottom part, connected by a hinge. This type of air cargo container is for instance known from GB 1470448.

Air cargo containers with a solid door provide the required rigidity but are significantly heavier than those with a flexible fabric door. Air cargo containers with a flexible door are lighter but require a shear panel to provide the necessary rigidity. The shear panel necessarily blocks part of the available opening however, and access to the interior of the container is therefore limited. This reduced access hinders loading and offloading and may lead to important time losses, in particular when using mechanical loading and offloading devices. Also, such mechanical devices may not always be suitable for use in conjunction with containers equipped with shear panels.

It would be highly desirable to provide an air cargo container combining the advantages of the container having a flexible door (low weight) and of the container equipped with a solid door (allowing optimal access to the entire interior of the air cargo container), and at the same time providing sufficient structural rigidity to comply with the abovementioned standards and specifications. This is particularly the case for so-called (half width) lower deck aircraft containers, having sides sloping outward and upward from the base—to which it is restraint.

BRIEF DESCRIPTION OF THE INVENTION

The invention thereto provides an air cargo container comprising a skeleton structure of interconnected frame members to which are arranged face panels forming a wall between the frame members, at least one of which walls comprises an opening providing access to the interior of the container, whereby the opening covers substantially the complete surface area of said wall between the outermost of the frame members, and whereby parts of the outermost frame members forming the peripheral edge of the opening are provided with connecting means for connecting a stiffening member to the peripheral edge, said stiffening member being provided to link said parts under tension.

The connecting means allow providing a container of the described type and comprising at least one stiffening member connected to the connecting means and linking said parts of the peripheral edge of the opening under tension. The stiffening member(s) preferably act(s) as tension-only element(s), and, together with the frame members encompassing the opening, form(s) a truss structure that turns out to provide the required structural rigidity to the container and yet provides an access opening that covers substantially the complete surface area of the wall(s) comprising the opening. With a tension-only element is meant a structural element that is adapted to be loaded in tension only, although a certain rigidity and strength may also be present in compression. Applying tension-only elements yields increased weight-savings.

The container of the invention provides the required rigidity and is preferably substantially free of any shear panel covering part of the opening to provide maximum access to the interior of the container and save considerable time when loading or offloading.

According to another aspect of the invention, the container comprises a door of a flexible material, substantially covering the complete surface area of the opening, and therefore also of the wall(s) that comprise(s) the opening. A lightweight air cargo container is thus provided that conforms to the requirements as set out by the National Aerospace Standard (NAS) 3610 and the International Air Transport Association (IATA) ULD Technical Manual.

Another embodiment of the invention provides a container wherein the connecting means are positioned such that when said parts are linked under tension by the stiffening members, the outermost frame members forming the peripheral edge of the opening are in compression in the unloaded state of the container.

In yet another more preferred embodiment, a container is provided wherein the outermost frame members forming the peripheral edge of the opening are in compression in the loaded state of the container.

Both the container with a flexible door and shear panel, as well as the container equipped with a solid door have in common that solid, inflexible parts—extruded stiffeners and/or solid door panels—are in place during flight and divide the front surface of the air cargo container into smaller sections, which by definition results in a higher structural strength and stiffness than if these parts would not be in place during flight. One solution to provide similar structural rigidity would be to make the container's structure and more specifically at location of the corners of the front surface significantly stiffer. For this, one could opt to use frame members with much greater wall thickness—adding weight to the air cargo container, and/or weld the adjacent frame members together—reducing the maintainability of the container, and/or use very large gusset plates to connect adjacent frame members—limiting access to the interior of the container.

The present invention offers an alternative solution that at the same time provides the required structural rigidity and offers maximum accessibility to air cargo containers.

In the present embodiment of the invention, the rigid outermost frame members, forming the edges of the container's front surface are primarily loaded in compression. At least two opposite corners of said edges are interconnected by means of a stiffening member that allows to be loaded under tension only. In order to profit from the benefits of the invention, the stiffening member and connecting means are preferably stiff and the maximum elongation of the stiffening member is preferably limited. The stiffening member further preferably starts to carry loads and contribute to the overall structural rigidity of the air cargo container as soon as loads are exerted on the container which result in a deformation of (the edges of) the container's front surface. Known stiffening members, such as webbings composed of polyester fibers and/or steel cables for instance, and known connecting means do not meet the requirements of this embodiment.

In a convenient embodiment of the invention, the flexible door comprises a sheet of fabric material that is attached to at least one of the frame members forming the peripheral edge of the opening, and preferably the top frame member of said edge. As such, the flexible door may conveniently be placed on top of the container during loading and/or offloading, without hindering operations.

Another embodiment of the invention provides a container wherein the door is attached to and/or comprises at least part of the stiffening member. This embodiment has the additional advantage of allowing easy attachment of the stiffening member(s) to the connecting elements when closing the opening off by the flexible door. The required structural rigidity is obtained when the door is equipped with stiffening members that for instance connect opposing corners of the container's door opening.

In a further embodiment, the stiffening member(s) comprise a polymer and/or metal of low density, and more preferred the stiffening member comprises continuous fibres and/or webbings of woven continuous fibres. The tension-only elements are preferably made from high-tensile strength, low-strain material and could either be cables or straps, or any other suitable material form. The fibres have a preferred tenacity of at least 10 g/d and a preferred tensile modulus of at least 200 g/d. This embodiment has the advantage that deformations, resulting from even the heaviest of in-flight load conditions, remain limited and within limits. This not only reduces maintenance cost, but also and more importantly, reduces the risk that the container can not be offloaded from the aircraft's cargo compartment easily after landing as a result of such deformations.

The members may conveniently be connected to the (extruded) frame members by means of either a permanent fixture or a door closure mechanism. In a preferred embodiment of the invention, a container is provided wherein some connection means are adapted to releasably connect the stiffening member(s) to the peripheral edge of the opening, particularly the lower peripheral edge of the container and/or the upstanding sides of the lower peripheral edge. Main advantage of this preferred embodiment is that the time necessary to open and/or close the container by the flexible door prior to or after loading or offloading is minimized.

In another aspect of the invention, a container is provided wherein the door comprises reinforcing elements at least at one edge thereof. Particularly preferred are reinforcing elements that comprise elongated fibre reinforced structural shapes, such as pultruded or extruded profiles. This embodiment prevents that access can be made to the contents of the container in closed configuration or a small object may be inserted in the container by slightly deforming or pulling outward the container's door.

In another aspect of the invention, a container is provided wherein the frame members forming the peripheral edge of the opening form a polygon, and preferably a pentagon, and wherein, more preferably, those parts of the frame members that are provided with the connecting means comprise the corners of the polygon. As such, the frame members forming the peripheral edge of the opening are loaded most favourably.

Another embodiment of the invention provides a container, wherein the polygon comprises a base edge and a side edge comprising a first part slantingly extending from said base edge and a second part extending from said first part substantially perpendicular to said base edge towards a ceiling edge of the container. The slanting part is required to conform to the cross-sectional shape of an aircraft fuselage thereby saving space.

A particularly preferred container comprises a stiffening member that at least extends from the corner connecting the base edge and the first part of the side edge to the corner connecting the second part of the side edge to the ceiling edge. More preferred the stiffening member at least extends from the corner connecting the first and second parts of the side edge to the corner connecting the base edge and another side edge, and most preferred the stiffening member at least extends from the corner connecting the first and second parts of the side edge to the corner connecting the ceiling edge and another side wall.

The preferred lower deck container comprises a stiffening member that at least extends from the corner connecting the base edge and the sloped lower side edge to the corner connecting the upper part of the side edge (connected to the sloped lower side edge) to the ceiling edge. More preferred the stiffening member at least extends from the corner connecting the sloped lower side edge and the upper part of the side edge to the corner connecting the base edge and another, opposite side edge, and most preferred the stiffening member at least extends from the corner connecting the sloped lower side edge and upper part of the side edge to the corner connecting the ceiling edge and another, opposite side edge.

Although the container according to the invention may relate to any type of container, a preferred embodiment of the container comprises a lower deck container, and more preferred a LD3 container. Such a type of container is known to the person skilled in the art.

Another aspect of the invention provides a flexible door for an air cargo container according to the invention. The flexible door comprises a sheet of a flexible material, comprising a stiffening member extending at least from one part of the peripheral edge of the sheet to another part of the sheet's peripheral edge and provided with connecting means for releasably connecting the stiffening member to the peripheral edge of the opening of the container. The advantages of such a flexible door have already been described above and will not be repeated here.

In a preferred embodiment, a flexible door is provided having the shape of a polygon with a base edge and at least one side edge part slantingly extending from said base edge, wherein the stiffening member(s) connect(s) at least some corners of the polygon, and preferably all corners of the polygon.

DESCRIPTION OF FIGURES

The invention will now be described by way of example without however being limited thereto and with reference to the accompanying figures, in which.

DETAILED DESCRIPTION OF THE INVENTION

Throughout this application, the term "about" is used to indicate that a value includes the standard deviation of error for the device or method being employed to determine the value.

The articles "a" and "an" are used herein to refer to one or to more than one, i.e. to at least one of the grammatical object of the article. By way of example, "a door" means one door or more than one door.

Throughout this application, the term "substantially" means more than 90% of the indicated value or property.

Figure 1:
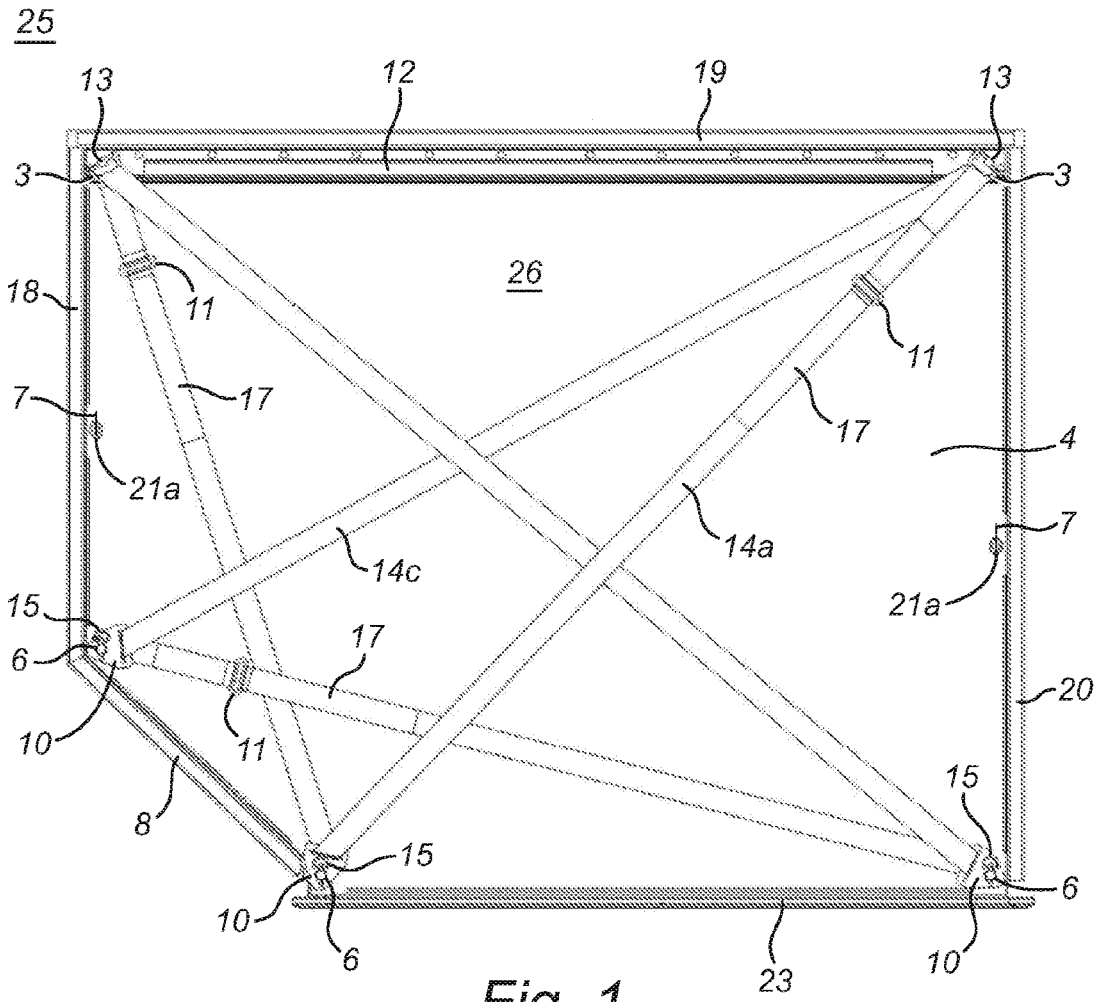
FIG. 1 is a front view of a lower-deck LD3 container constructed in accordance with and embodying the principles of the present invention, with a flexible fabric door in a closed position.
Figure 4:
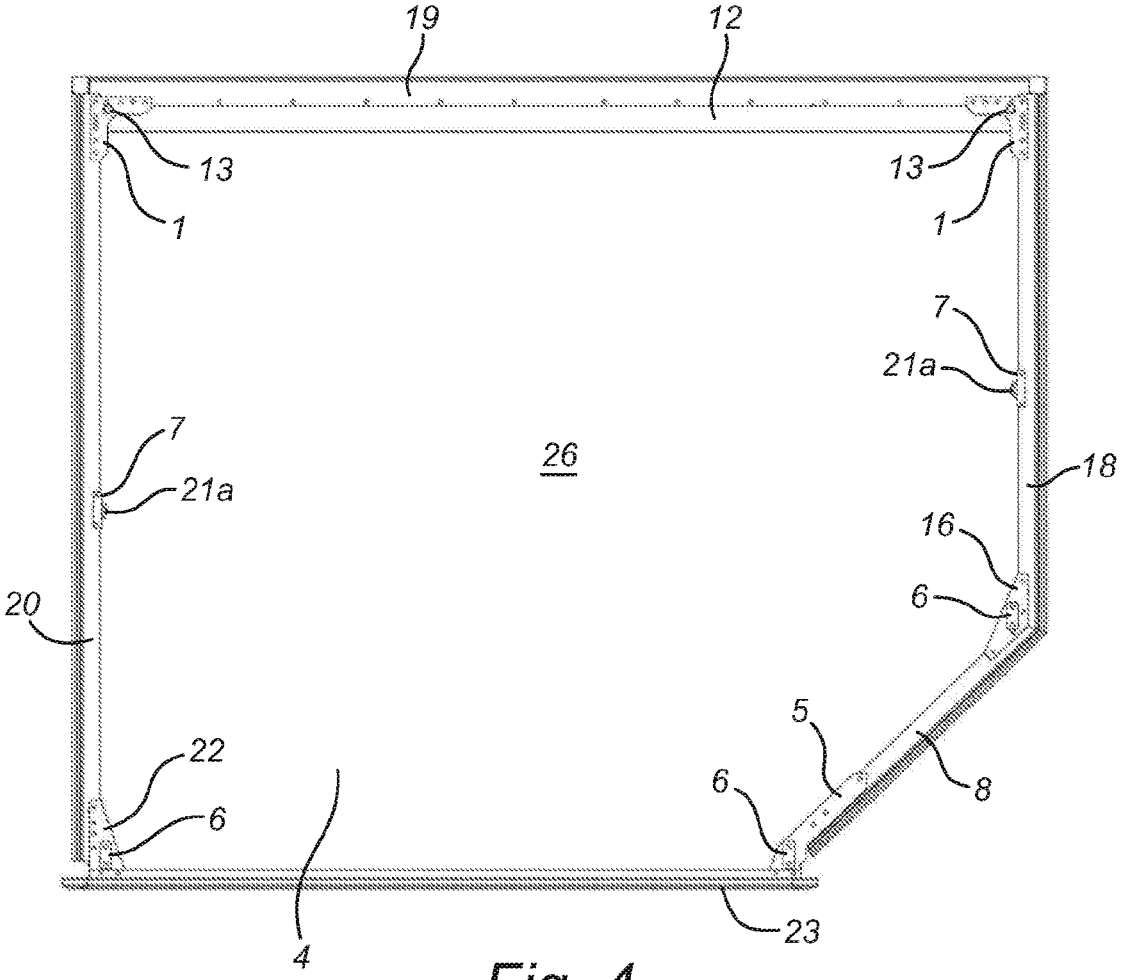
FIG. 4 is a back view of the door structure of the container as shown in FIG. 1.
Figure 5:
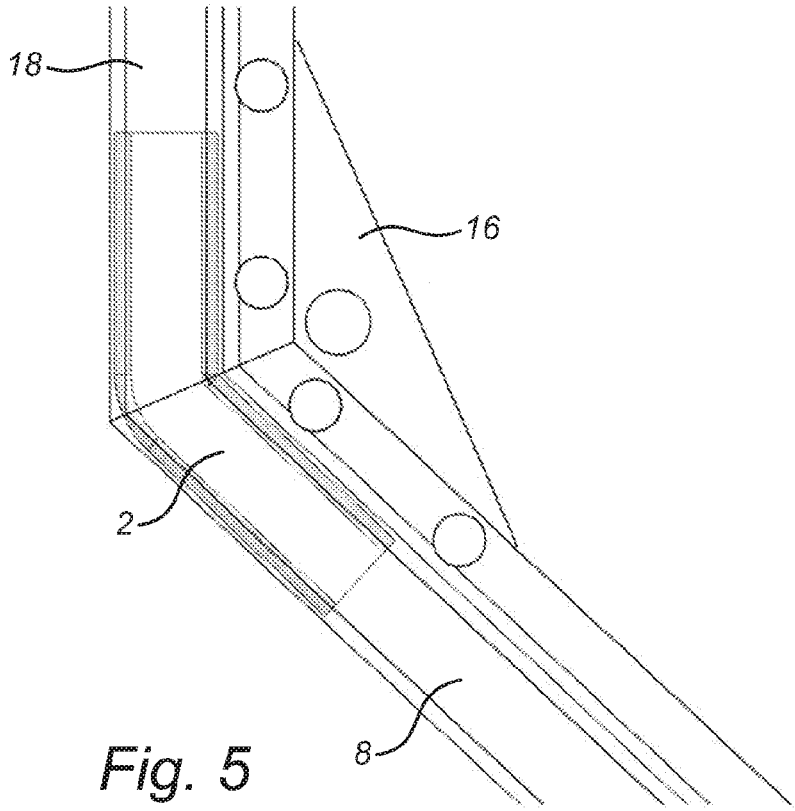
FIG. 5 is a front view of the container as shown in FIG. 1, presenting the outboard corner structure.

Referring to FIG. 1 there is illustrated a lower-deck LD3 type air cargo container 25 made in accordance with and embodying the principles of the present invention. The air cargo container 25 in three dimensions comprises a skeleton structure of interconnected frame members (8, 18, 19, 20, and base 23 and others that are not shown in the figure and extend perpendicular to frame members 8, 18, 19, 20, and base 23), To the frame members are arranged face panels (not shown) forming a wall between the respective frame members. At least one of the walls comprises an opening providing access to the interior of the container 25. The opening may be temporarily closed by a door 26. The container's door structure comprises a frame structure, composed of slanted lower outboard frame member 8, vertical inboard frame member 20, both of which are connected to base 23, horizontal upper frame member 19 and vertical outboard frame member 18, connecting members 8 and 19. Referring now to FIGS. 1, 4 and 5, upper frame member 19 is connected to vertical frame members 18 respectively 20 by means of gussets 1. Furthermore, a connection between frame members 8 and 18 is established by means of gusset 16 and stiffening element 2. Stiffening element 2 is inserted in the hollow sections of frame members 8 and 18, thus establishing a rigid connection between the two. Connection between base 23 and frame members 8 and 20 is created with gussets 5 and 22 respectively.

The opening covers substantially the complete surface area of the wall between the outermost frame members 8, 18, 19, 20, and base 23. Please note that other frame members may be present such as a frame member (not shown) extending vertically upwards from the node that connects frame members 8 and base 23 to meet and connect to upper frame member 19. Such a frame member is not an outermost frame member.

Referring to FIGS. 1, 2, 4, 6 and 8, the fabric door 26 is permanently connected to the container's frame structure by means of extruded member 12, which in turn is connected to horizontal upper frame member 19. The rod-shaped edge 24 of fabric door 26 is fully enclosed by a tubular hollow section of extruded member 12, thus forming a hinge-like connection. The door structure is closed off by fabric door 26, or more in particular fabric panel 4.

Referring to FIG. 1, all opposing corners of the container's door structure are in closed configuration connected by stiffening members 14*a*, 14*b* and 14*c*, comprising webbings, composed of woven high tenacity continuous fibres. Members 14*a*, 14*b* and 14*c* form one integral structural component and are interlinked by strap connectors 11. The length of the individual members can be adapted by use of Velcro closures of the strap type 17. At least over part of its length, the stiffening members are joined to fabric door 26, or fabric panel 4 in particular.

Referring now to FIGS. 1 and 4, members 14*b* and 14*c* are permanently connected to the container's door structure, or more particularly through linkages 3 and pins 13 to gussets 1. Furthermore, for opening and closing purposes, stiffening members 14*a*, 14*b* and 14*c* have non-permanent linkages to the door structure, more particular through buckles 10 and pins 6 to gussets 5, 16 and 22 respectively. Removable lock pins 15 are in place to assure these linkages remain in place and the container maintains its closed configuration.

Figure 7:
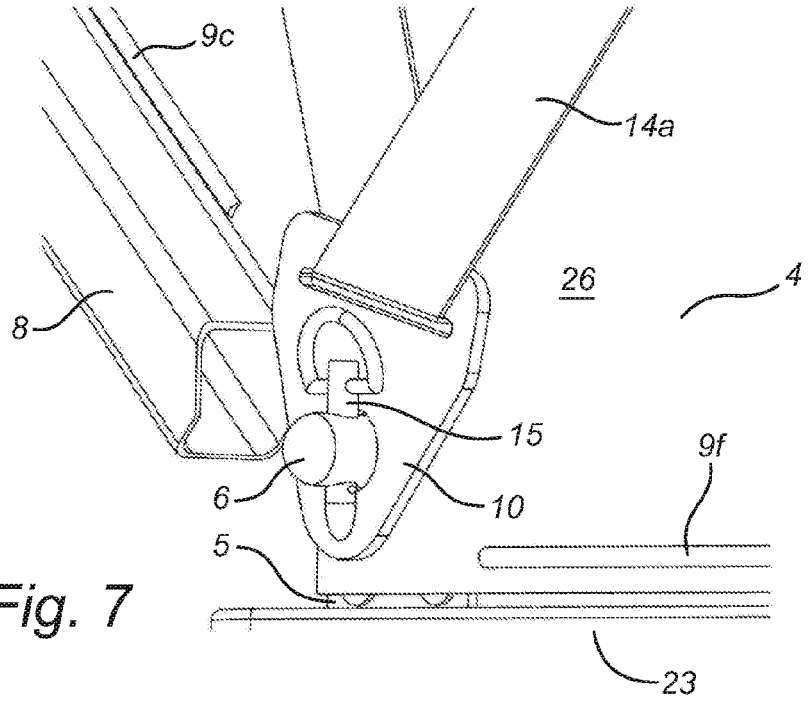
FIG. 7 is a perspective view of the container as shown in FIG. 1, presenting the lower outboard corner structure.
Figure 8:
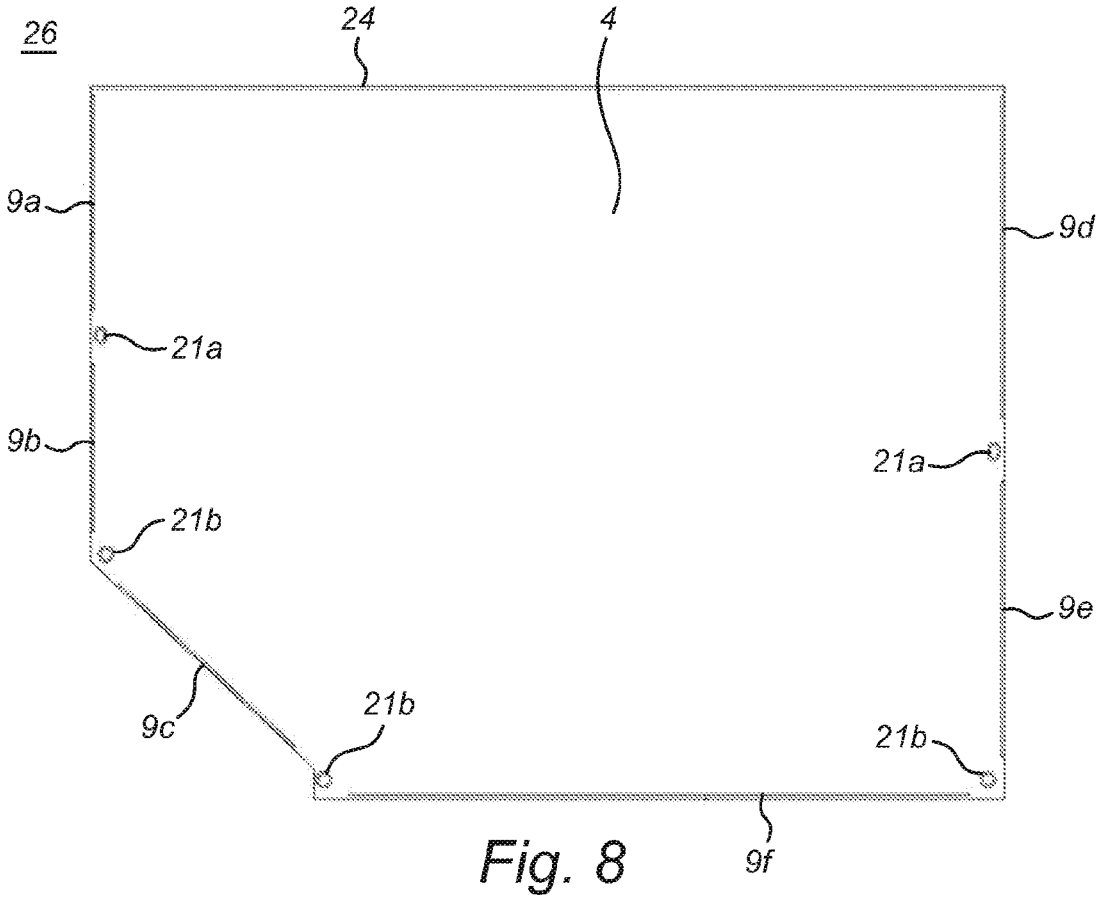
FIG. 8 is a front view of the fabric door of the container as shown in FIG. 1.

Referring to FIGS. 1, 4 and 8, fabric door 26 is equipped with eyelets 21*a* for establishing connection between the fabric door 26 and the frame structure, more particularly with door hooks 7. Fabric door 26 is furthermore equipped with eyelets 21*b*, purposed to facilitate closure of the air cargo container by connecting the stiffening members 14*a*, 14*b* and 14*c* to the container's door structure, more particularly buckles 10 to pins 6. Furthermore, referring to FIGS. 7 and 8, fabric door 26 is equipped with tubular stiffening elements 9*a*, 9*b*, 9*c*, 9*d*, 9*e* and 9*f*, made of fibre reinforced plastic material and purposed to strengthen the edges of fabric panel 4.

Figure 2:
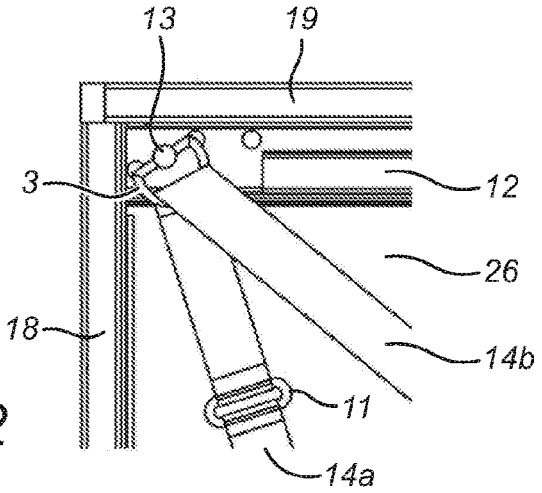
FIG. 2 is an enlarged front view of the container as shown in FIG. 1, presenting the upper outboard part of the container.

Referring now to FIG. 2, frame members 18 and 19, extruded member 12, fabric door 26, stiffening members 14*a* and 14*b*, connected by strap connector 11 as well as linkage 3 and pin 13 are disclosed in more detail.

Figure 3:
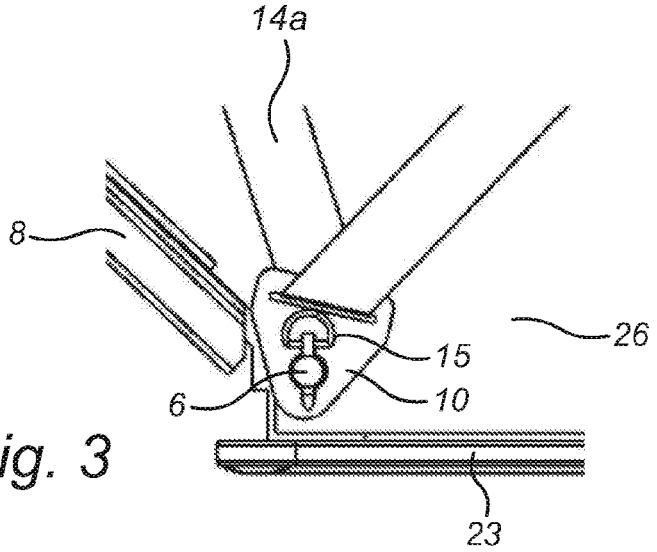
FIG. 3 is an enlarged front view of the container as shown in FIG. 1, presenting the lower outboard part of the container.

Furthermore, FIG. 3 discloses base 23, frame member 8, fabric door 26, stiffening member 14*a*, buckle 10, pin 6 and lock pin 15 in more detail.

Figure 6:
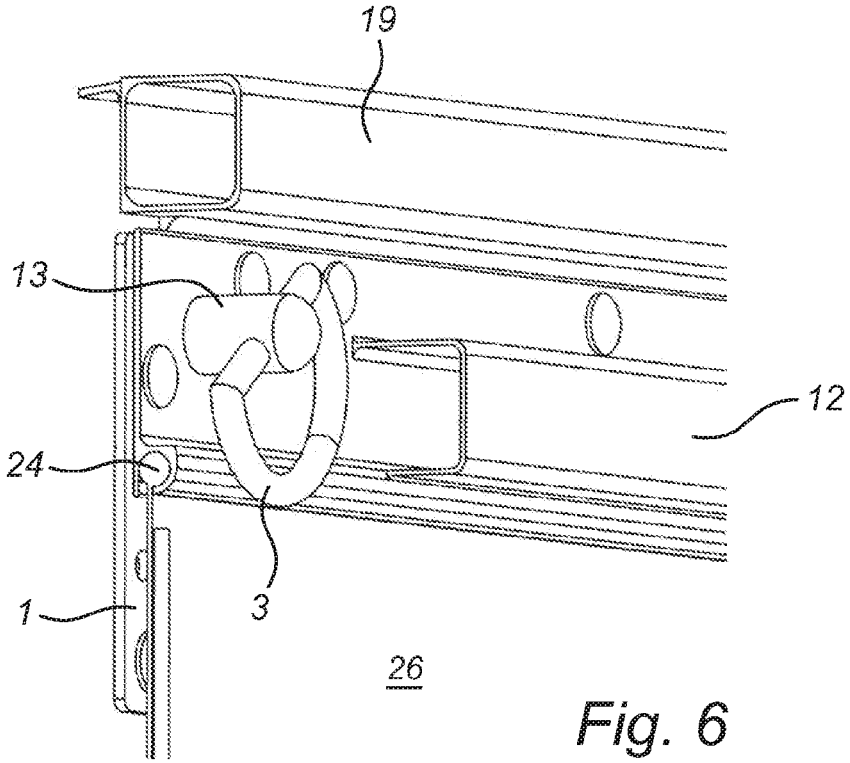
FIG. 6 is a perspective view of the container as shown in FIG. 1, presenting the upper outboard corner structure.

FIG. 6 shows frame member 19, extruded member 12, linkage 3, pin 13, gusset 1, fabric door 26 and its rod-shaped edge 24 in a perspective view and in greater detail.

Finally, in FIG. 6 are shown in a perspective way: fabric door 26, composed of fabric panel 4 and stiffening elements 9*c* and 9*f* as well as base 23, gusset 5, stiffening member 14*a*, buckle 10, pin 6, lock pin 15 and frame member 8.

The invention claimed is:

1. Air cargo container comprising a skeleton structure of interconnected frame members to which are arranged face panels forming at least one wall between the frame members, the at least one wall defining an opening that provides access to an interior space of the air cargo container and covers substantially a complete surface area of the at least one wall between outermost frame members, wherein the outermost frame members form edges of a front surface of the air cargo container, and parts of the outermost frame members form peripheral edges of the opening, wherein said parts are provided with connecting means for connecting a stiffening member to the peripheral edges of the opening, said stiffening member linking said parts under tension, wherein the outermost frame members forming the peripheral edge of the opening form a pentagon, and the parts of the outermost frame members that are provided with the connecting means comprise corners of the pentagon; and the air cargo container further comprising a door comprising a flexible material substantially covering the complete surface area of the opening.

2. Air cargo container according to claim 1, wherein the stiffening member is connected to the connecting means and links said parts of the outermost frame members under tension.

3. Air cargo container according to claim 1, the air cargo container being substantially free of any shear panel covering part of the opening.

4. Air cargo container according to claim 1, wherein the connecting means are positioned such that when said parts are linked under tension by the stiffening members, the outermost frame members forming the peripheral edges of the opening and the edges of the front surface of the air cargo container are in compression in an unloaded state of the air cargo container.

5. Air cargo container according to claim 1, wherein the door comprises a sheet of fabric material that is attached to at least one of the outermost frame members forming the peripheral edges of the opening.

6. Air cargo container according to claim 2, wherein the door is attached to at least part of the stiffening member, comprises at least part of the stiffening member, or a combination thereof.

7. Air cargo container according to claim 2, wherein the stiffening member comprises continuous fibers, webbings of woven continuous fibres, or a combination thereof.

8. Air cargo container according to claim 7, wherein said fibres have a tenacity of at least 10 g/d and a tensile modulus of at least 200 g/d.

9. Air cargo container according to claim 1, wherein the door comprises reinforcing elements at least at one edge of the door.

10. Air cargo container according to claim 9, wherein the reinforcing elements comprise elongated fibre reinforced structural shapes.

11. Air cargo container according to claim 1, wherein some connecting means are adapted to releasably connect the stiffening member to the peripheral edges of the opening.

12. Air cargo container according to claim 1, wherein the pentagon comprises a base edge and a side edge comprising a first part slantingly extending from said base edge and a second part extending from said first part substantially perpendicular to said base edge towards a ceiling edge of the air cargo container.

13. Air cargo container according to claim 12, wherein the stiffening member is connected to the connecting means, links said parts of the peripheral edges of the opening under tension, and at least extends from a corner connecting the base edge and the first part of the side edge to a corner connecting the second part of the side edge to the ceiling edge.

14. Air cargo container according to claim 13, wherein the stiffening member at least extends from a corner connecting the first and second parts of the side edge to a corner connecting the base edge and another side edge of the pentagon.

15. Air cargo container according to claim 13, wherein the stiffening member at least extends from the corner connecting the first and second parts of the side edge to a corner connecting the ceiling edge of the air cargo container and another side edge of the pentagon.

16. Air cargo container according to claim 1, wherein the air cargo container comprises a lower deck container.

17. Air cargo container according to claim 16, wherein the air cargo container comprises a LD3 container.

* * * * *